US011786777B1

(12) United States Patent
Sleamaker

(10) Patent No.: US 11,786,777 B1
(45) Date of Patent: Oct. 17, 2023

(54) MULTI-PURPOSE EXERCISE MACHINE

(71) Applicant: Robert Sleamaker, Underhill, VT (US)

(72) Inventor: Robert Sleamaker, Underhill, VT (US)

( * ) Notice: Subject to any disclaimer, the term of this patent is extended or adjusted under 35 U.S.C. 154(b) by 200 days.

(21) Appl. No.: 16/812,341

(22) Filed: Mar. 8, 2020

Related U.S. Application Data

(60) Provisional application No. 62/907,827, filed on Sep. 30, 2019.

(51) Int. Cl.

| | |
|---|---|
| ***A63B 21/00*** | (2006.01) |
| ***A63B 21/22*** | (2006.01) |
| ***A63B 102/18*** | (2015.01) |
| ***A63B 69/06*** | (2006.01) |
| ***A63B 69/10*** | (2006.01) |
| ***A63B 102/32*** | (2015.01) |

(52) U.S. Cl.
CPC ..... *A63B 21/156* (2013.01); *A63B 21/225* (2013.01); *A63B 21/4013* (2015.10); *A63B 21/4035* (2015.10); *A63B 69/06* (2013.01); *A63B 69/10* (2013.01); *A63B 2069/062* (2013.01); *A63B 2069/068* (2013.01); *A63B 2102/18* (2015.10); *A63B 2102/32* (2015.10); *A63B 2244/20* (2013.01)

(58) Field of Classification Search
CPC ... A63B 21/156; A63B 21/225; A63B 21/4013; A63B 21/4035; A63B 69/06; A63B 69/10; A63B 2069/062; A63B 2069/068; A63B 2102/18; A63B 2102/32; A63B 2244/20; A63B 21/154-156; A63B 7/00; A63B 7/02; A63B 7/04; A63B 7/045; A63B 21/005-0052; A63B 21/0056-0057; A63B 21/15-156; A63B 21/22-227; A63B 21/4001; A63B 21/4017; A63B 21/4019; A63B 21/4021; A63B 21/4029; A63B 21/4033; A63B 21/16-169
See application file for complete search history.

(56) References Cited

U.S. PATENT DOCUMENTS

| | | | | |
|---|---|---|---|---|
| 5,072,934 | A * | 12/1991 | Blanes | A63B 21/1627 482/904 |
| 5,385,525 | A * | 1/1995 | Davis | A63B 21/0552 482/121 |
| 8,647,239 | B1 * | 2/2014 | Sokolovas et al. | A63B 21/153 482/56 |
| 11,052,279 | B1 * | 7/2021 | Vujicic et al. | A63B 21/4035 |
| 2003/0032528 | A1 * | 2/2003 | Wu et al. | A63B 21/225 482/92 |

(Continued)

*Primary Examiner* — Joshua Lee
*Assistant Examiner* — Catrina A Letterman
(74) *Attorney, Agent, or Firm* — Staniford Tomita LLP

(57) ABSTRACT

An exercise machine includes a frame which contains a flywheel which rotates around an axle coupled to spools. Original cords are wrapped around the spools and extend to upper pulleys on the frame. The original cords are coupled to adapter cords which extend to lower pulleys on the exercise machine. By pulling the adapter cords, the spools are rotated which causes the flywheel to spin. The adapter cords are released and springs retract the original cords so they can be pulled again. The lower pulleys lower the exit position of the adapter cords so that the exercise machine can be used with hand paddles to simulate swimming, paddle shafts to simulate paddling movements, exercise handles to simulate upper body functional exercises, or ankle straps to simulate lower body functional exercises.

20 Claims, 13 Drawing Sheets

(56) References Cited

U.S. PATENT DOCUMENTS

| | | | | |
|---|---|---|---|---|
| 2005/0143230 | A1* | 6/2005 | Dalebout et al. | A63B 23/12<br>482/121 |
| 2012/0277068 | A1* | 11/2012 | Zhou et al. | A63B 21/157<br>482/71 |
| 2014/0135181 | A1* | 5/2014 | Smith | A63B 21/152<br>482/139 |
| 2017/0319941 | A1* | 11/2017 | Smith et al. | A63B 21/06 |
| 2020/0069988 | A1* | 3/2020 | Gore | A63B 21/154 |
| 2020/0114194 | A1* | 4/2020 | McGhee | A63B 21/169 |

* cited by examiner

MULTI-PURPOSE EXERCISE MACHINE

CROSS REFERENCE TO RELATED APPLICATION

This application claims priority to U.S. Provisional Pat. Application No. 62/907,827, "Adapter for Exercise Machine" filed Sep. 30, 2019 which is hereby incorporated by reference in its entirety.

BACKGROUND

Exercise machines such as home gyms are very popular. Many exercise machines are dedicated towards a single sport. For example, cross country ski machines are specifically designed to build arm and leg muscles used for cross country skiing. What is needed is an improved system which will allow a dedicated machine to be used for multiple activities and sports.

DETAILED DESCRIPTION

Figure 1:
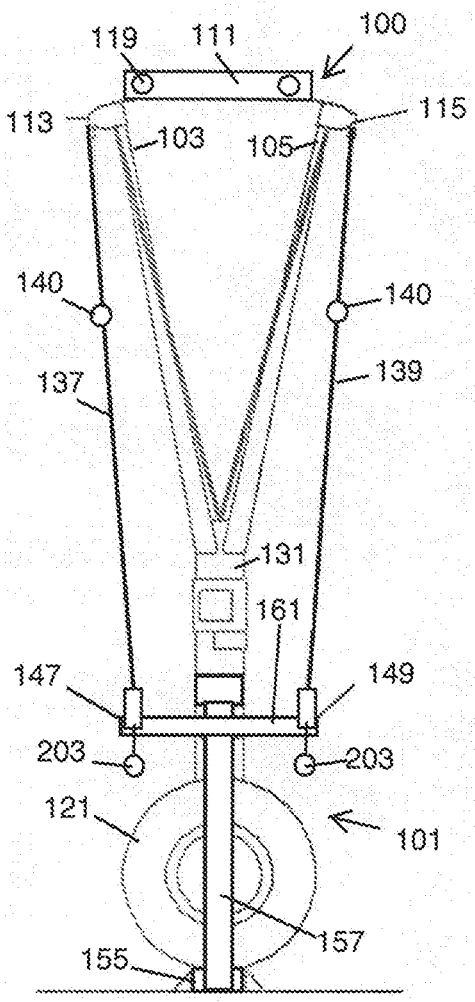
FIG. 1 illustrates a front view of a wall-mounted embodiment of an exercise machine.
Figure 2:
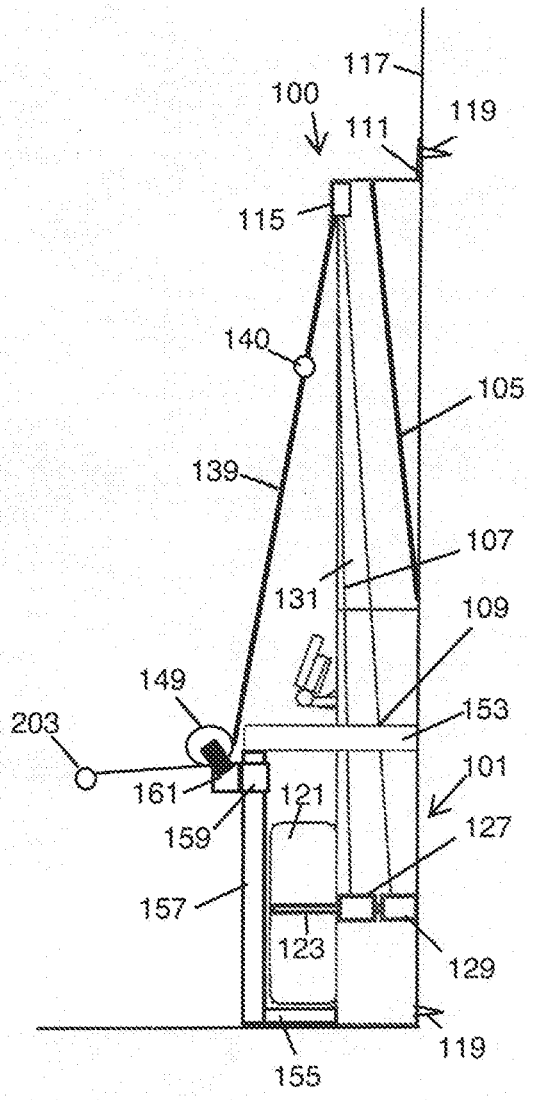
FIG. 2 illustrates a side view of a wall-mounted embodiment of an exercise machine.

FIG. 1 illustrates a front view and FIG. 2 illustrates a side view of a wall-mounted embodiment of an exercise machine 100 that is used for cross country skiing poling simulations. The frame 131 of the exercise machine 100 structure has a base 101 and an elongated split upper section having an upper left section 103 and an upper right section 105. The exercise machine base 101 has a flywheel 121 which rotates about an axle which is coupled to the frame 131. A bracket 111 is mounted to the top of the exercise machine 100 for securing the exercise machine to a wall 117 with fasteners 119 such as screws, nails, bolts, etc. A left first upper pulley 113 is attached to an elongated upper left section 103 of the frame 131 and a right second upper pulley 115 is attached to an elongated upper right section 105 of the frame 131.

In the original configuration, the ends of the original cords 107, 109 can be coupled to simulated ski pole handles (not shown) which are used for simulated cross country ski exercise. However, in the illustrated embodiments, ski handles can ben replaced with adapter cord couplings 140 mounted on the ends of the original cords 107, 109. The cord couplings 140 are used to connect the first original cord 107 to a first adapter cord 137 and the second original cord 109 to a second adapter cord 139. The cord couplings 140 can be any known mechanism which can securely couple the original cords 107, 109 to the adapter cords 137, 139. For example, in an embodiment, the cord couplings 140 can include a loop coupled to the ends of the original cords 107, 109 and closable carabiners on the ends of the adapter cords 137, 139. In yet another embodiment, the cord couplings 140 can be cord knots.

The flywheel 121 can have a mass and a disk shape which rotates about an axle 123. The flywheel 121 can have a resistance mechanism which provides rotational drag to resist the rotation of the flywheel 121. This resistance mechanism can be based upon various mechanical forces such as friction, fluid viscosity, aerodynamic drag, magnetism, magnetic fields, etc. In an embodiment, the resistance mechanism can be adjustable so that a user can reduce the resistance when the user is a novice or starting training and then increase the resistance as the user's strength increases.

The flywheel 121 can rotate. A first spool 127 and a second spool 129 can each include a ratchet mechanism and can be coupled to the flywheel axle 123 so the axle 123 rotates with the spools 127, 129 in a first rotational direction and the axle 123 can rotate freely relative to the spools 127, 129 in the opposite rotational direction. The first original cord 107 is wound around the first spool 127 and a second original cord 109 is wound around the second spool 129. The first original cord 107 extends from the first spool 127 through the first upper pulley 113 attached to the upper left section 103 of the frame 131. A coupling 140 is attached to exposed end of the first original cord 107 and the first adapter cord 137 extends down through the first lower pulley 147. The second original cord 109 extends from the second spool 129 through the second upper pulley 115 attached to the upper right section 105 of the frame 131 and a coupling 140 is attached to exposed end of the first original cord 107. The second adapter cord 139 extends down to the second lower pulley 149. In an embodiment, the original cords 107, 109 may bend through an angle between 130 and 180 degrees through the upper pulleys 113, 115 and the adapter cords 137, 139 may bend through an angle of 60 to 120 through the lower pulleys 147, 149.

The spools 127, 129 can be coupled to rotational springs. When the original cords 107, 109 are pulled the spools 127, 129 rotate the axle 123 and flywheel 121 which provides resistance. When the original cords 107, 109 are released, the rotational springs will retract the original cords 107, 109 into the exercise machine 100 and rewind the original cords 107, 109 onto the spools 127, 129. The original cords 107, 109 can be attached to the adapter cords 137, 139 with cord couplings 140.

A first device coupling 203 can be coupled to the end of the first adapter cord 137 and a second device coupling 203 can be coupled to the end of the second adapter cord 139. Various exercise devices can be coupled to the first device coupling 203 and the second device coupling 203. The user can then manipulate the exercise device to pull the first device coupling 203 and the second device coupling 203 away from the exercise machine 100 which will resist the pulling forces. The user can then move the exercise device towards the exercise machine 100 and the rotational springs will retract the original cords 107, 109.

In an embodiment, the frame 131, flywheel 121, upper pulleys 113, 115 and upper sections of the frame 103, 105 are part of a cross country exercise machine such as the Concept 2 Ski Erg wall mounted machine. In an embodiment, the lower pulleys 147, 149 can be coupled to a crossbar assembly which is attached to the frame 131. In an embodiment, the crossbar assembly 151 can have an upper bracket 153 which can have a horizontal configuration which is attached to the frame 131 above the flywheel 121 and a lower horizontal bracket 155 which can be attached to the frame 131 below the flywheel 121. A vertical rail 157 can be attached to the upper bracket 153 and lower horizontal bracket 155. A crossbar 161 can have two ends which are coupled to the two lower pulleys 147, 149 and a vertical position coupling 159 which is attached to the vertical rail 157. The vertical position coupling 159 allows the crossbar 161 to be positioned at a vertical position that matches the user's exercise activity and personal preference. While the vertical rail 157 is shown as being about one third the height of the frame 131, in other embodiments, the vertical rail 157 can be longer in length and can possibly extend upward over half the height of the frame 131. The position of the crossbar 161 can be proportional to the height and/or position of the user. The crossbar 161 can be raised for a taller user and lowered for a shorter user. The crossbar 161 can be raised when the user is standing and lowered when the user is standing, laying on a bench, or in a seated position.

The vertical bracket 157, upper bracket 153, lower bracket 155, and crossbar 161 can be made of hollow tubes which can have round, square or rectangular cross sections. These components can be made of metals such as steel, aluminum, metal alloys, or other materials such as carbon fiber, other composite materials, or wooden. A tightening mechanism can be used to clamp the vertical coupling 159 to any vertical position on the vertical bracket 157. For example, in an embodiment, the tightening mechanism can include a threaded hole and threaded bolt. The bolt can be screwed into the threaded hole and the inner surface of the bolt can be compressed against the vertical bracket 157 to lock the crossbar 161 in the desired vertical position. Alternatively, the vertical position coupling 159 can have a pin which engages with a hole in the vertical bracket 157. For example, the crossbar 161 can be moved to the desired vertical position and the pin can be inserted into the hole that most closely matches the desired vertical position. The vertical coupling 159 can have an open inner square or rectangular cross section which surrounds a square or rectangular outer vertical bracket 157.

When the first adapter cord 137 and/or second adapter cord 139 are pulled, the first original cord 107 and/or second original cord 109 are pulled the spools 127, 129 are rotated which rotates the axle 123 and flywheel 121. When the adapter cords 137, 139 are stopped, the spools 127, 129 which are coupled to ratchet mechanisms will stop rotating and the ratchet mechanism will allow the flywheel 121 to continue to rotate about the axle 123. The resistance mechanism will cause the flywheel's 121 rate of rotation to slow. The first spool 127 can have a first retraction spring which rewinds the first original cord 107 onto the first spool 127 when the first adapter cord 137 is released, and the second spool 129 can have a second retraction spring which rewinds the second original cord 109 onto the second spool 129 when the second adapter cord 139 is released.

Figure 3:
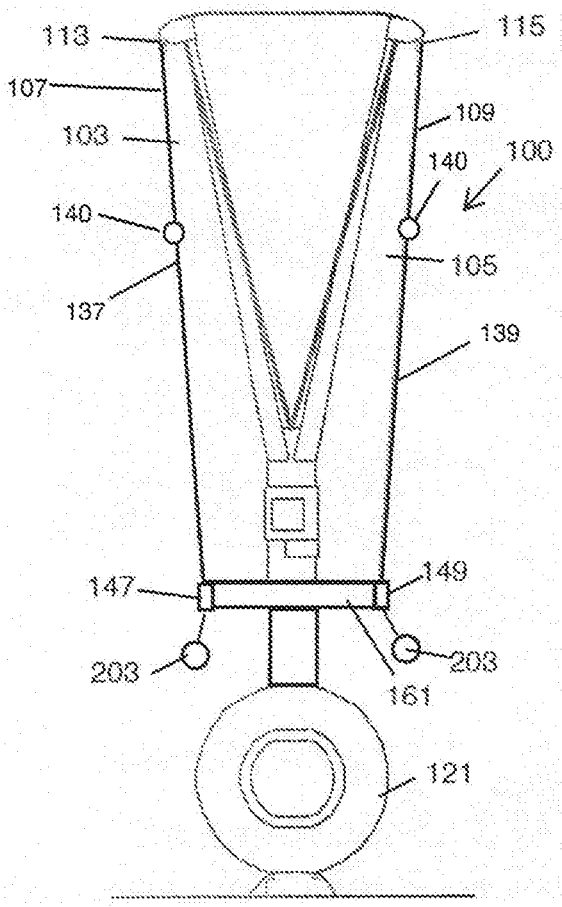
FIG. 3 illustrates a front view of a wall-mounted embodiment of an exercise machine.
Figure 4:
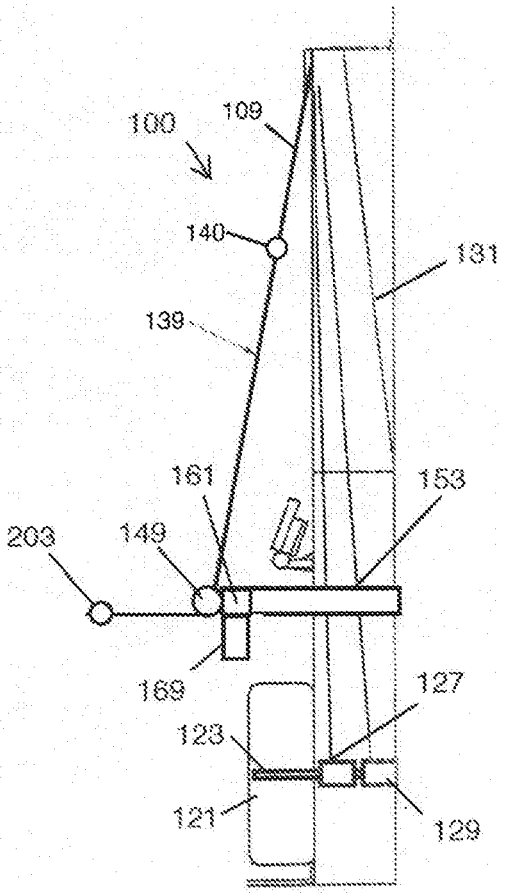
FIG. 4 illustrates a side view of a wall-mounted embodiment of an exercise machine.

FIG. 3 illustrates a front view and FIG. 4 illustrates a side view of a wall mounted embodiment of an exercise machine 100 which is the same basic exercise machine illustrated in FIGS. 1 and 2. The frame 131 of the exercise machine 100 is an elongated structure that has a base and a split upper section having an upper left section 103 and an upper right section 105. The exercise machine 100 has a flywheel 121 which rotates about an axle 123 which is coupled to the base of the frame 131. A left first upper pulley 113 is attached to an upper left section 103 of the frame 131 and a right second upper pulley 115 is coupled to the upper right section 105 of the frame 131.

Figure 7:
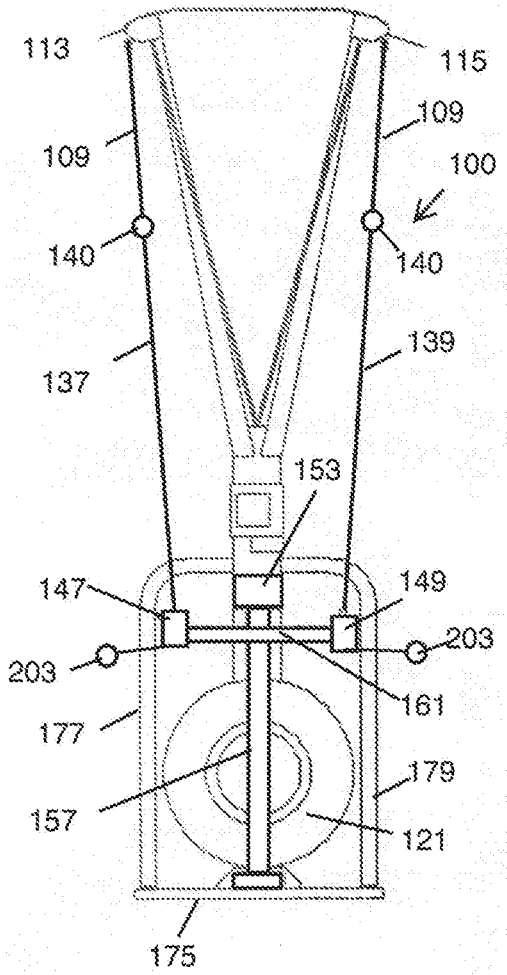
FIG. 7 illustrates a front view of a floor stand embodiment of an exercise machine with floor stand rails.
Figure 8:
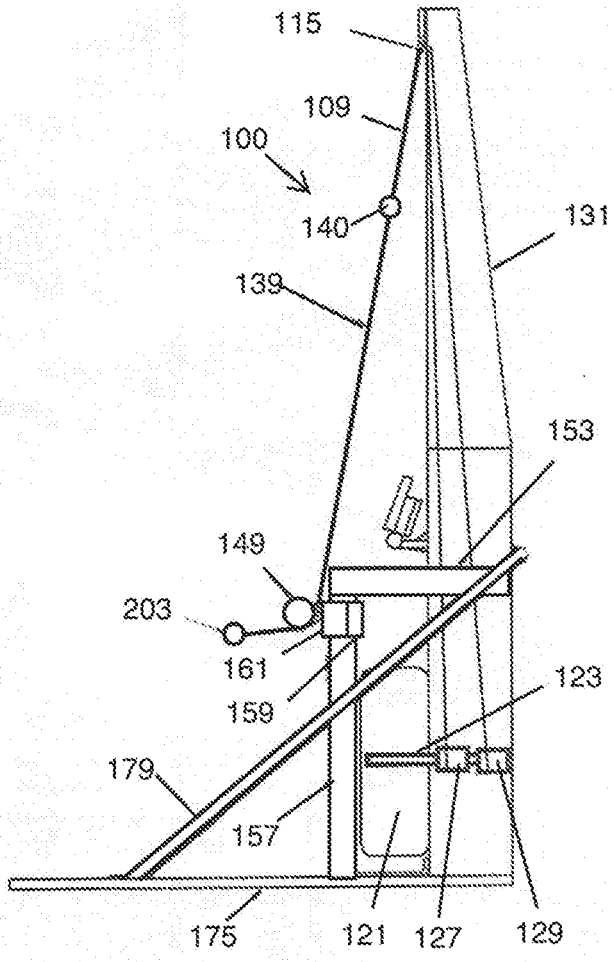
FIG. 8 illustrates a side view of a floor stand embodiment of an exercise machine with floor stand rails.

FIG. 7 illustrates a front view and FIG. 8 illustrates a side view of a floor stand embodiment of an exercise machine 100 which is the same exercise machine 100 illustrated in FIGS. 1 and 2. However, in this floor stand embodiment, the frame 131 of the exercise machine 100 is an elongated structure that has a base and a split upper section. The exercise machine 100 has a flywheel 121 which rotates about an axle 123 which is coupled to the base of the frame 131. A left first upper pulley 113 is attached to an upper left section of the frame 131 and a right second upper pulley 115 is coupled to the upper right section of the frame 131. A floorboard 175 is mounted to the bottom of the frame 131 and the floor stand rails 177, 179 are configured at angled positions between the frame 131 and the floorboard 175. The floorboard 175 and floor stand rails 177, 179 are secured to the exercise machine in an upright position and prevent the frame 131 from falling when the cords are pulled.

Figure 5:
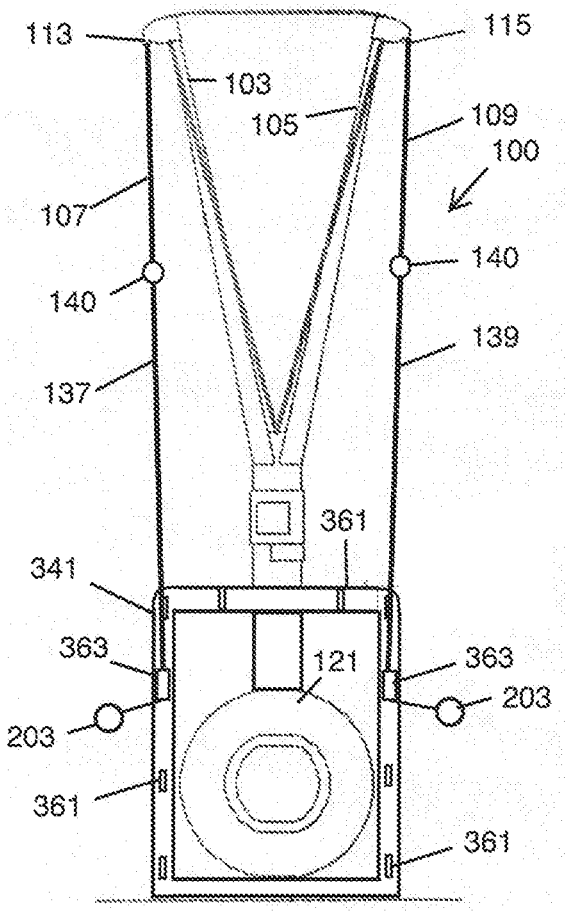
FIG. 5 illustrates a front view of a wall-mounted embodiment of an exercise machine.
Figure 6:
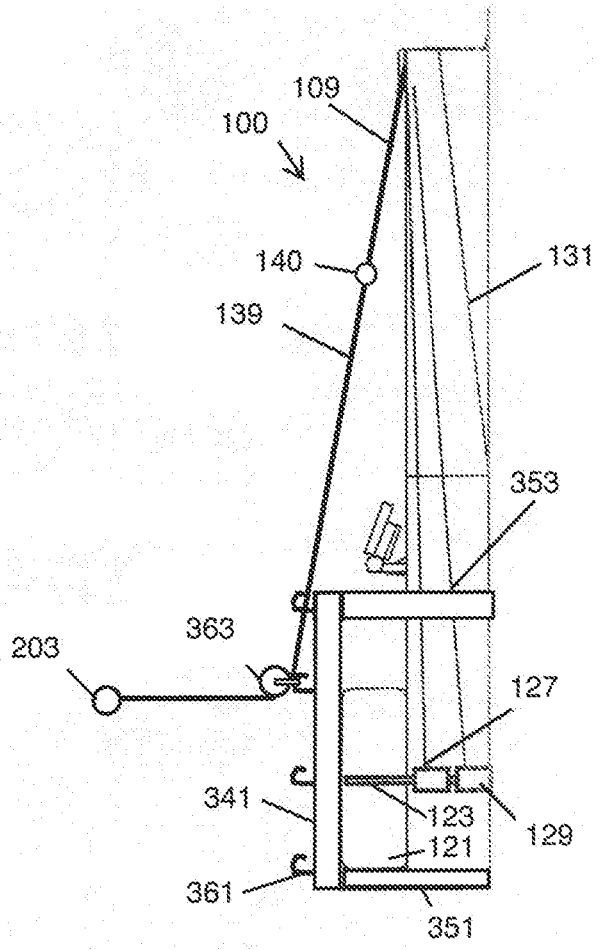
FIG. 6 illustrates a side view of a wall-mounted embodiment of an exercise machine.

FIGS. 5 and 6 illustrate front and side views of a wall mounted embodiment of an exercise machine 100 which is the same basic exercise machine illustrated in FIGS. 1 and 2. In the illustrated embodiment, a bracket 341 is attached to the exercise machine 100 with upper support member 353 and lower support member 351 which rigidly secure the bracket 341 to the exercise machine 100. A plurality of mounting hooks 361 are placed on the front facing surface of the of the bracket 341. Lower pulleys assemblies 363 can be placed on the mounting hooks 361 at the desired locations. In this example, the lower pulley assemblies 363 have loops which are placed in the mounting hooks 361. In an embodiment, the mounting hooks 361 can have locks which can prevent the lower pulley assemblies 363 from accidentally being removed from the mounting hooks 361. In other embodiments, any other mechanism can be used to attach the lower pulley assemblies 363 to the desired positions on the bracket 341.

FIG. 7 illustrates a front view and FIG. 8 illustrates a side view of a floor stand embodiment of an exercise machine 100 which is the same exercise machine 100 illustrated in FIGS. 1 and 2. However, in this floor stand embodiment, the frame 131 of the exercise machine 100 is an elongated structure that has a base and a split upper section. The exercise machine 100 has a flywheel 121 which rotates about an axle 123 which is coupled to the base of the frame 131. A left first upper pulley 113 is attached to an upper left section of the frame 131 and a right second upper pulley 115 is coupled to the upper right section of the frame 131. A floorboard 175 is mounted to the bottom of the frame 131 and the floor stand rails 177, 179 are configured at angled positions between the frame 131 and the floorboard 175. The floorboard 175 and floor stand rails 177, 179 are secured to the exercise machine in an upright position and prevent the frame 131 from falling when the cords are pulled.

In this embodiment the crossbar assembly can be the same as that described for the wall mount embodiment above. The vertical bracket 157, upper bracket 153, and crossbar 161 can be made of hollow tubes. For example, the vertical coupling 159 can have an inner square cross section which surrounds the vertical bracket 157. A tightening mechanism can be used to clamp the vertical coupling 159 to any vertical position on the vertical bracket 157. For example, the vertical coupling 159 can be moved on the vertical bracket 157 can be moved to the desired vertical position and the pin can be inserted into the hole that most closely matches the desired vertical position. The vertical coupling 159 can have an open inner square or rectangular cross section which surrounds a square or rectangular outer vertical bracket 157.

Figure 9:
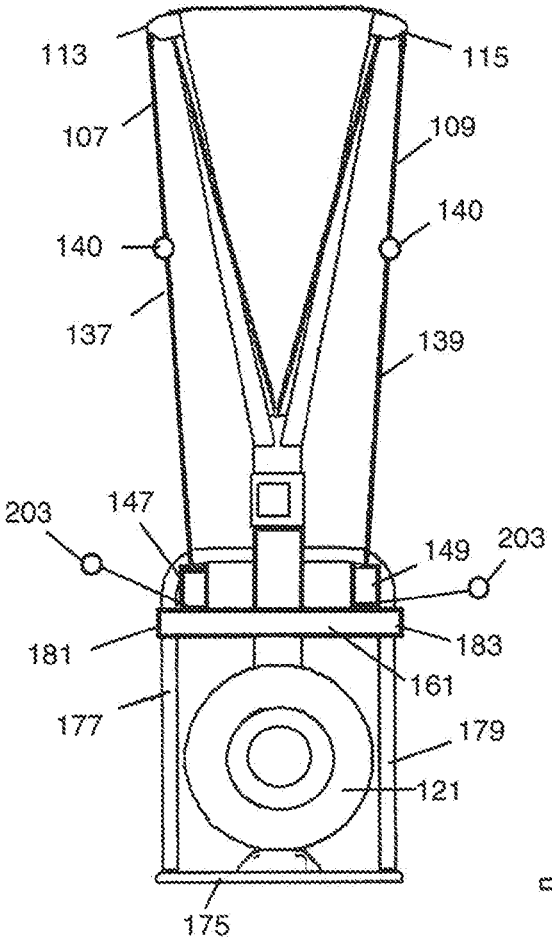
FIG. 9 illustrates a front view of a floor stand embodiment of an exercise machine with floor stand rails.
Figure 10:
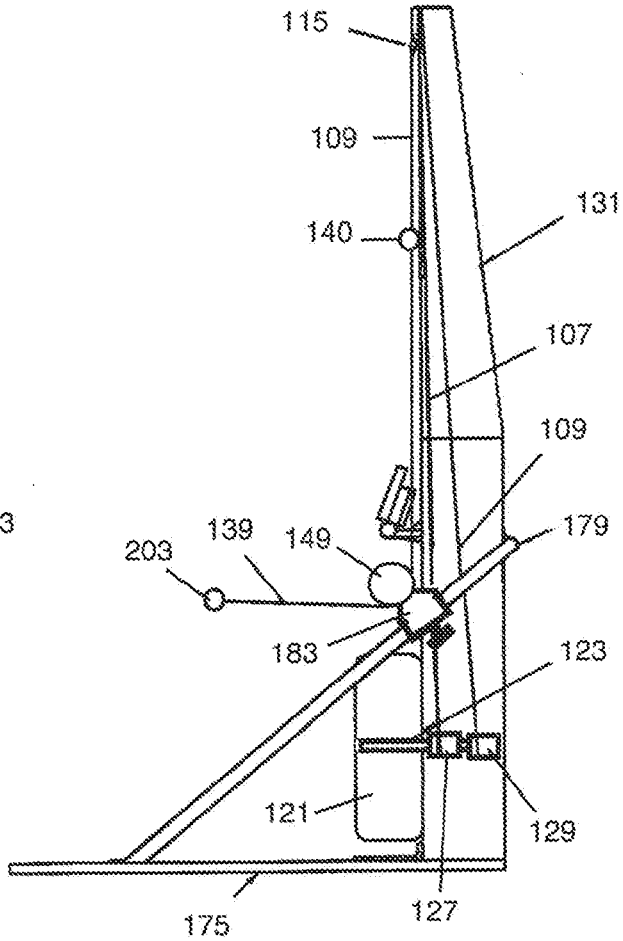
FIG. 10 illustrates a side view of a floor stand embodiment of an exercise machine with floor stand rails.

FIG. 9 illustrates a front view and FIG. 10 illustrates a side view of a floor stand embodiment of an exercise machine 100 which is the same exercise machine 100 illustrated in FIGS. 7 and 8. The floorboard 175 and floor stand rails 177, 179 secure the exercise machine 100 in an upright position and prevent the frame 131 from falling when the original cords 107, 109 are pulled. In this embodiment, the lower left pulley 147 and lower right pulleys 149 are attached to a horizontal crossbar 161 which is coupled to the floor stand rails 177, 179 with a left rail coupling 181 and a right rail coupling 183. The crossbar can be positioned at any desired vertical position on the floor stand rails 177, 179. The couplings 181, 183 are tightened to secure the crossbar 161, the lower left pulley 147 and the lower right pulley 149 to the floor stand rails.

Figure 11:
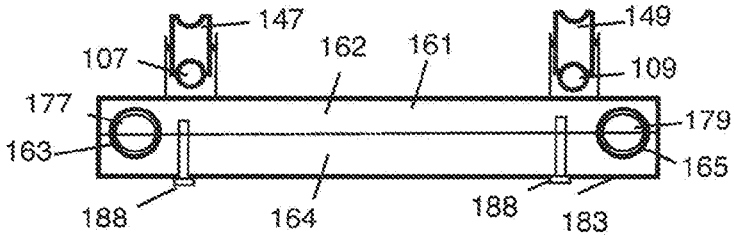
FIG. 11 illustrates a front view of an embodiment of a crossbar attachment.

FIG. 11 illustrates a front view of an embodiment of the crossbar 161 which can include an upper piece 162, a lower piece 164, a first left crossbar hole 163 and a second right crossbar hole 165. The left floor stand rail 177 is placed in the first left crossbar hole 163 and the right floor stand rail 179 is placed in the second right crossbar hole 165. When the crossbar 161 is moved to the desired location, coupling mechanisms 188 can be tightened to secure the crossbar 161 to the stand rails 177, 179. In the illustrated example, the upper side of the crossbar 161 can have threaded holes and the lower side of the crossbar 161 can have holes which are aligned with the threaded holes. In this example, the coupling mechanisms 181 and 183 can be threaded bolts which are tightened to secure the crossbar 161 to the stand rails 177, 179 and prevent movement of the crossbar 161. In an embodiment, the first left lower pulley 147 and the second right lower pulley 149 can be moved horizontally to any position across the width of the crossbar 161 and locked in the desired position. For example, the left lower pulley 147 and the second right lower pulley 149 can be attached to structures (similar to couplings 181 shown in FIGS. 8, 11, and 12) which surround the crossbar 161 and can be moved to a desired position and clamped to secure the left lower pulley 147 and the second right lower pulley 149 in the desired positions. Alternatively, the crossbar 161 can include a track which is attached to the first left lower pulley 147 and the second right lower pulley 149 (which can be similar to the track 195 and adjustable coupling 191 shown in FIG. 15). Thus, the first left lower pulley 147 and the second right lower pulley 149 can be moved to a wide range of vertical and horizontal positions.

Figure 12:
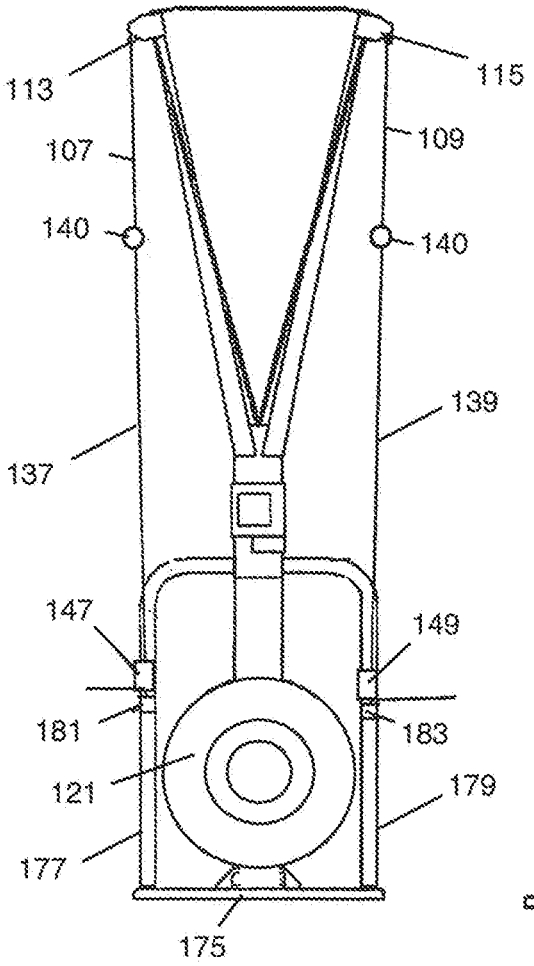
FIG. 12 illustrates a front view of a floor stand embodiment of an exercise machine with floor stand rails.
Figure 13:
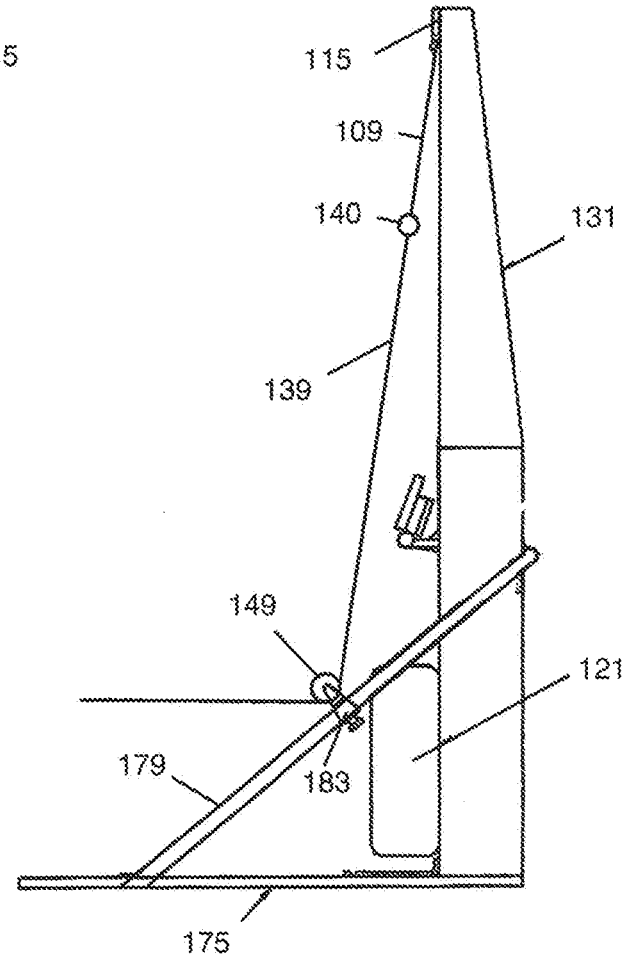
FIG. 13 illustrates a side view of a floor stand embodiment of an exercise machine with floor stand rails.

FIG. 12 illustrates a front view and FIG. 13 illustrates a side view of a floor stand embodiment of an exercise machine. A floorboard 175 is mounted to the bottom of the frame 131 and the floor stand rails 177, 179 are configured at angled positions between the lower frame 131 and the floorboard 175. In this embodiment, a first left rail pulley 147 is mounted on the first left floor stand rail 177 and a second right rail pulley 149 is mounted on the second right floor stand rail 179. The pulleys 147, 149 can be attached to adjustable couplings 181, 183 which allows the pulleys 147, 149 to be moved and secured to any position on the length of the rails 177, 179. In an embodiment, the adjustable couplings 181, 183 can be clamps which can be placed around the rails 177, 179 and tightened to secure the pulleys 147, 149 to any desired location on the rails 177, 179. Once the pulleys 147, 149 are secured to the floor stand rails 177, 179, the first adapter cord 137 can be fed through the first lower left pulley 147 and the second adapter cord 139 can be fed through the second lower right pulley 149. The first adapter cord 137 and the second adapter cord 139 can be pulled by the user to perform physical exercise. In this embodiment, the crossbar assembly is not necessary and not part of the exercise machine structure.

Figure 14:
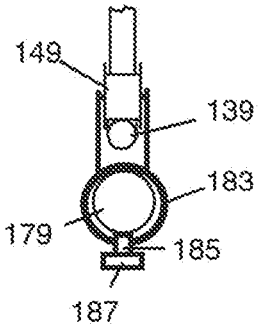
FIG. 14 illustrates a front view of an embodiment of a pulley floor stand rail coupling.

FIG. 14 illustrates a cross section view of an embodiment of an adjustable coupling 183 attached to a pulley 149 through which the second adapter cord 139 is placed. In this example, the rail 179 can be cylindrical in shape and have a cross section with a circular outer surface. The coupling 183 can have an inner surface which matches the outer shape of the rail 179. In this example, the inner surface of the coupling 183 can be a cylindrical surface which surrounds the rail 179. The coupling 183 can have a threaded hole and a threaded bolt 185. A rotational feature 187 can be mounted on the outer end of the threaded bolt 185. The rotational feature 187 can be a structure which allows a user to grasp and rotate the threaded bolt 185 to tighten and secure the adjustable coupling 183 to rail 179. In other embodiments, the rotational feature 187 can have a drive tool structure such as a screw driver or wrench fitting which can include screw slots, hexagonal bolt head, hex key recess, torque key recess, or another similar tool feature. Once the coupling 183 is moved to the desired position on the rail 179, the coupling mechanism can be tightened and the second adapter cord 139 can be tensioned. In different embodiments, surfaces of the coupling 183 that contact the rail 179 can be high friction materials such as plastic, rubber or textured surfaces which will prevent movement of the coupling 183.

Figure 15:
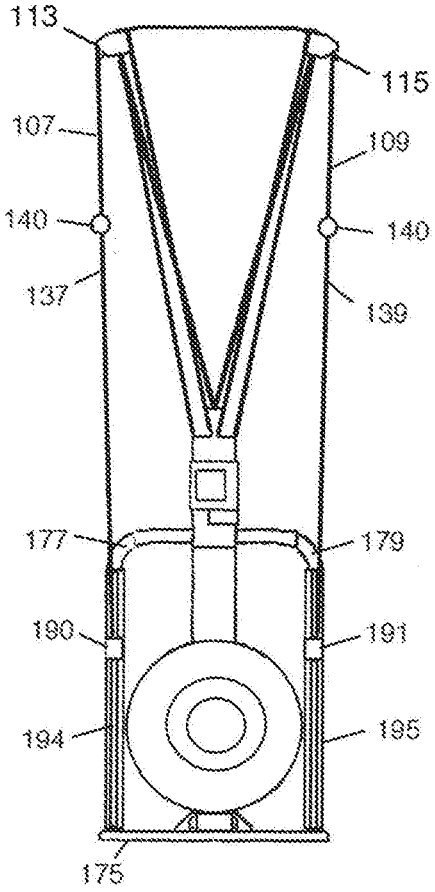
FIG. 15 illustrates a front view of a floor stand embodiment of an exercise machine with floor stand rails.
Figure 16:
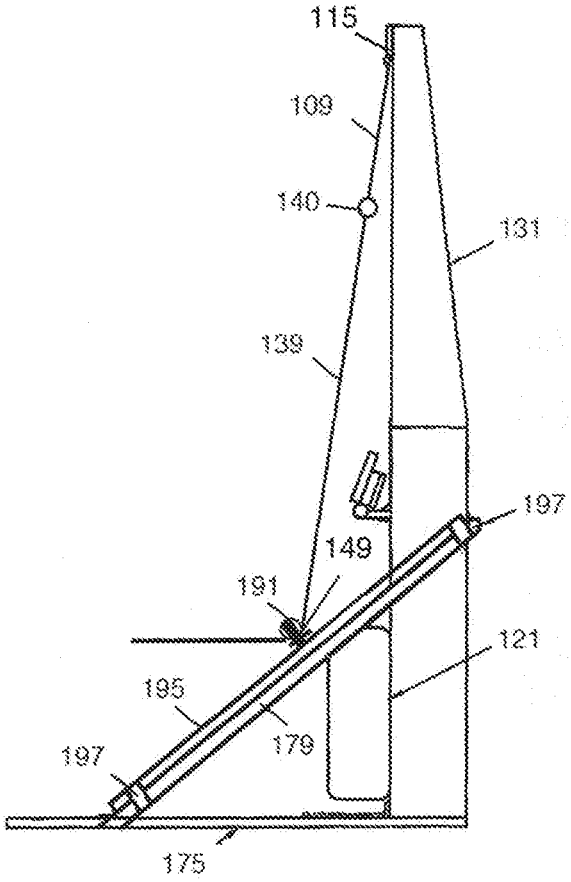
FIG. 16 illustrates a side view of a floor stand embodiment of an exercise machine with floor stand rails.

FIG. 15 illustrates a front view and FIG. 16 illustrates a side view of a floor stand embodiment of an exercise machine. A floorboard 175 is mounted to the bottom of the frame 131 and the floor stand rails 177, 179 are configured at angled positions between the lower frame 131 and the floorboard 175. In this embodiment, a first left track pulley assembly 190 is mounted on the first left floor stand rail 177 and a second right track pulley assembly 191 is mounted on the second right floor stand rail 179. The first left track pulley assembly 190 can be secured to the first left floor stand rail 177 and the second right track pulley assembly 191 can be secured to the second right floor stand rail 179 with a plurality of releasable couplings 197. The releasable couplings 197 can be straps that can be wrapped and tightened around the rails 177, 179 to securely attach the tracks 194, 195 to the rails 177, 179. The rail assemblies 190, 191 can be moved and secured to any position on the length of the rails 177, 179. In other embodiments, any other type of coupling mechanism can be used to secure the tracks 194, 195 to the rails 177, 179, such as threaded bolts, clamps, etc. The first cord 107 can be fed through the first lower left pulley 147 and the second cord 109 can be fed through the second lower right pulley 149. The first cord 107 and the second cord 109 can be pulled by the user to perform physical exercise.

Figure 17:
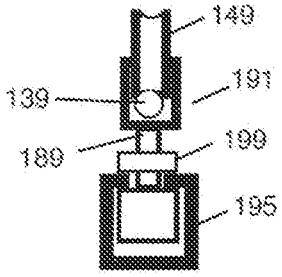
FIG. 17 illustrates a front view of an embodiment of a pulley floor stand rail coupling.

With reference to FIG. 17, an embodiment of the track 195 can include an open inner volume and a slot in the upper surface. A lower portion of the adjustable couplings 197 can fit within the track 195 and have a matching cross section shape. In this example, the track 195 can have a hollow rectangular shape and the lower portion of the adjustable coupling 191 can have a rectangular outer surface which is smaller than the inner hollow rectangular shape. A threaded rod 189 can extend through the slot which couples the pulley 149 to the lower portion. The threaded nut 199 can be mounted on the threaded rod 189. The adjustable coupling 197 can be moved to any position on the track 195. Once the pulley 149 is moved to the desired position on the track 195, the nut 199 can be rotated and tightened against the upper surface of the track 195 to secure the adjustable coupling 191 to the track 195. In an embodiment, the outer surface of the nut 199 can have flat surfaces so that the nut 199 can be tightened with a wrench. Alternatively, the outer surface of the nut 199 can grip surfaces so that the nut 199 can be tightened by hand to the track 195.

Figure 18:
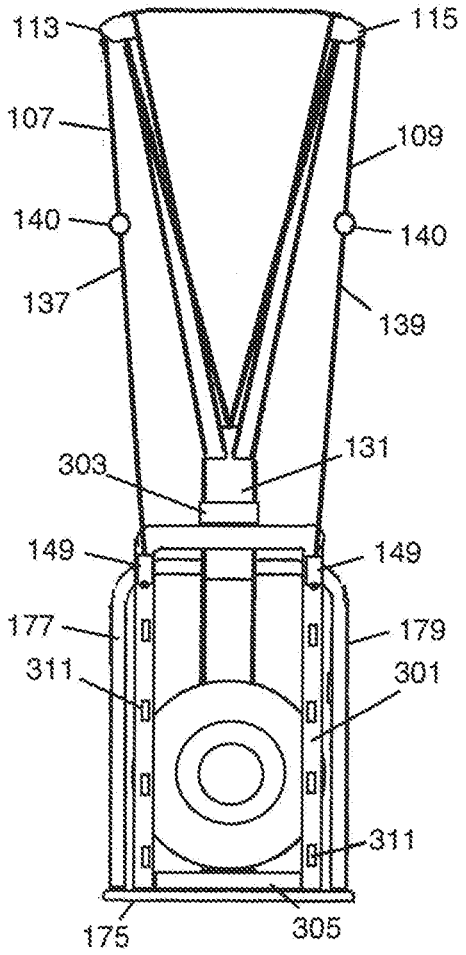
FIG. 18 illustrates a front view of a floor stand embodiment of an exercise machine with floor stand rails.
Figure 19:
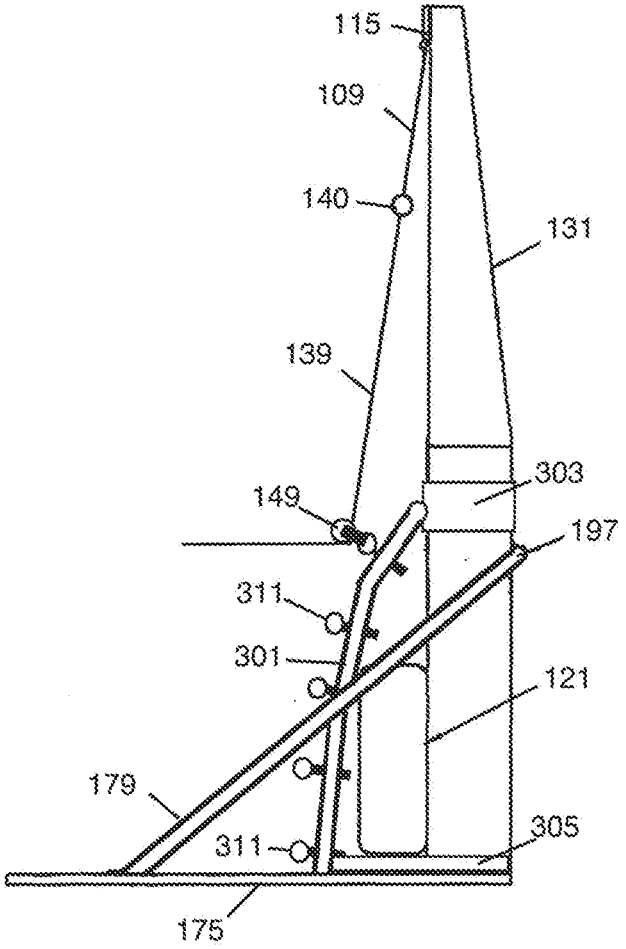
FIG. 19 illustrates a side view of an embodiment of a pulley floor stand rail coupling.

FIG. 18 illustrates a front view and FIG. 19 illustrates a side view of a floor stand embodiment of an exercise machine which has a inverted "U" shaped bracket 301 that is mounted to the frame 131 with an upper frame mount attachment 303 and a lower frame mount attachment 305. The bracket 301 can have an upper horizontal portion and two vertical legs which can have a convex curve in a vertical plane. The bottoms of the vertical legs are attached to a lower frame mount attachment 305. The upper horizontal portion of the bracket 301 is coupled to the upper frame mount attachment 303 that is attached around an upper portion of the frame 131. In different embodiments, the upper frame mount attachment 303 and the lower frame mount attachment 305 are attached to the frame 131 with fasteners such as screws, bolts or similar couplings. In other embodiments, the upper frame mount attachment 303 and the lower frame mount attachment 305 are 303 can fully or partially surround the frame 131 to prevent the movement of the bracket 301 relative to the frame 131. The upper frame mount attachment 303 can be two clamps which are secured to the left and right sides of the frame made of 12-gauge steel sheet that are attached to the bracket 301 with a top strap made of 10-gauge steel sheet. The bracket 301 can be made of 1.25-inch diameter × 0.065-inch wall thickness hot rolled 1010 steel which has two 90-degree bends and a convex curve. The lower frame mount attachment 305 can be made of 12 gage steel sheet material.

The bracket 301 can include a plurality of loops 311 which can be metal eyelets, hooks, or other coupling structures. In an embodiment, the loops 311 can be coupled to threaded rods which extend through holes in the bracket 301 and threaded nuts can be threaded onto the exposed ends of the threaded rods to secure the loops 311 in place on the bracket 301. In some embodiments, the holes in the bracket 301 can have female threads and the threaded rods can be screwed into threaded holes in the bracket 301. A thread lock mechanism can be used to secure the threaded rods into the threaded holes in the bracket 301. In an embodiment, the loops 311 can be ⅜-inch eye bolts which can be closed or open to allow the pulleys to be attached. The positions of the loops 311 can be positioned at 5 evenly spaced levels between 2 to 26 inches above the ground. The vertical spacing between the loops 311 can be at 6-inch intervals.

A lower left pulley 147 is attached to one of the loops 311 on the left side of the bracket 301 and a lower right pulley 149 is attached to one of the loops 311 on the left side of the bracket 301. The lower pulleys 147, 149 can have releasable couplings which allow the lower pulleys 147, 149 to be moved to any of the loops 311 on the bracket 311 as desired by the user.

The original cord 107 can be fed through the upper left pulley 113 and the original cord 109 can be fed through the upper right pulley 115. The ends of the original cords 107, 109 are attached to couplings 140. The adapter cords 137, 139 are attached to the couplings and the adapter cords 137, 139 can be fed through the lower pulleys 149. The adapter cords 137, 139 can be pulled by the user to perform physical exercise. In the illustrated example, the lower pulleys 149 are attached to the highest loop 311 which results in the adapter cords 137, 139 extending at a high vertical position away from the bracket 301. The lower pulleys 149 can be mounted on any of the loops 311 to adjust the vertical exit positions of the adapter cords 137, 139. In this example, the bracket 301 is shown mounted on a floor board embodiment of the exercise machine, the bracket 301 can also be used with a wall mount embodiment of the exercise machine which is shown in FIGS. 1-6.

The original cords 107, 109 and the adapter cords 137, 139 used with the described exercise machines can have various configurations. In an embodiment, the cords 107, 109, 137, 139 can be single piece structures which are releasably coupled to various specialty exercise devices. In other embodiments, the cords 107, 109, 137, 139 can have multiple cord segments which allow the lengths of the cords 107, 109, 137, 139 to be adjustable. In an embodiment, the cord segments can have couplings at the ends of the cord segments. For example, couplings such as hooks can be attached to the ends of the first original cord 107 to the first adapter cord 137 and the second original cord 109 to the second adapter cord 139. The couplings can be located at the outlet end of the upper pulleys, at the outlet end of the lower pulleys and/or at the ends of cords that extend a predetermined distance from the lower pulleys. The couplings can be used to couple the different cord segments together. The ends of the cords can be coupled to various different exercise devices such as hand grips, ankle loops, and/or paddles. The exercise devices can include swim paddles, exercise handles, Ski ERG handles, canoe paddle shafts, SUP paddle shafts, kayak paddle shafts, ankle straps, baseball bats, golf clubs, racket sports handles, cross-country ski machine accessories, and other gripping devices.

Figure 20:
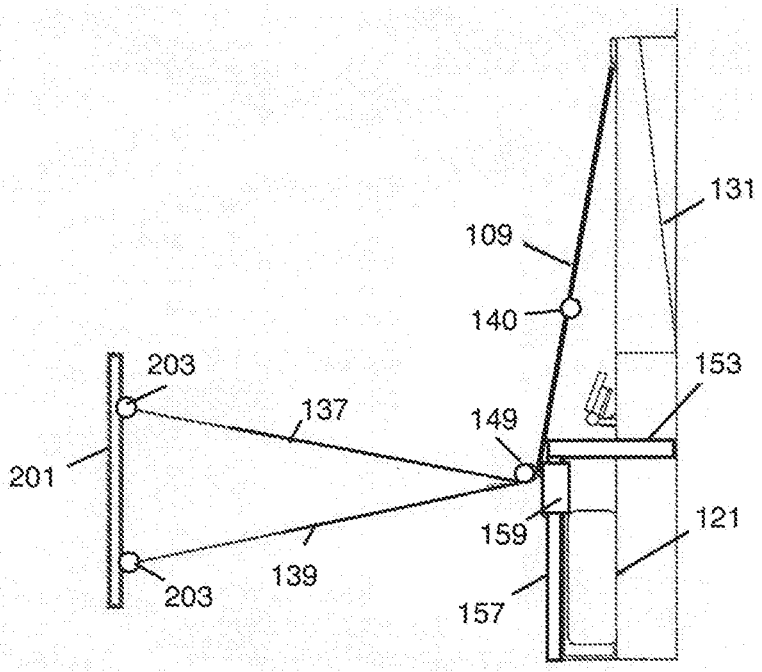
FIG. 20 illustrates a side view of a paddle shaft used with the exercise machine.

With reference to FIG. 20, a first side of a exercise paddle shaft 201 is attached to the first adapter cord 137 and a second opposite side of the paddle shaft 201 is attached to the second adapter cord 139 at bar couplings 203. The user can hold the paddle shaft 201 with both hands. The user can then move the paddle shaft 201 in a manner that simulates kayak paddling. When the first side of the paddle shaft 201 is pulled towards the user, the first original cord 107 is pulled and the first spool rotates the axle and flywheel 121 and simultaneously the second side of the paddle shaft 201 can be moved back towards the frame 131 and the second retraction spring can wind the second original cord 109 back onto the second spool. The user can then pull on the second side of the paddle shaft 201 which pulls the second adapter cord 139 and the second original cord 109 and rotates the second spool to rotate the axle and flywheel 121 and simultaneously the first retraction spring can wind the first original cord 107 onto the first spool.

Figure 21:
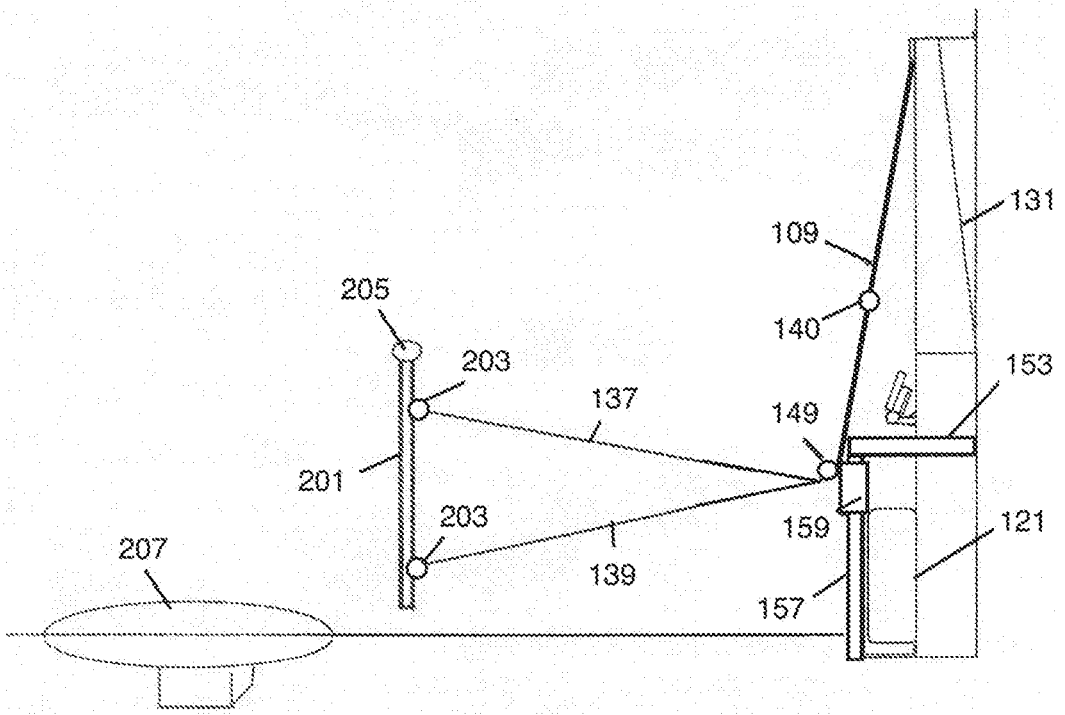
FIG. 21 illustrates a side view of a paddle shaft used with the exercise machine.

With reference to FIG. 21, in an embodiment, the paddle shaft 201 can have a hand grip 205 on one end. The user can grasp the hand grip 205 with one hand and hold a center portion of the paddle shaft 201 with the other hand. The user can pull the entire paddle shaft 201 away from the frame which can simultaneously pull both the first adapter cord 137 and second adapter cord 139 which pulls the original cords 107, 109 which rotate the first and second spools, the axle and flywheel 121. After each stroke, the user can move the paddle shaft 201 towards the exercise machine which causes the first original cord 107 and second original cord 109 to be wound onto the first and second spools. This method can be used to simulate standup paddle boarding (SUP), canoe paddling, or other paddle sporting goods. In the illustrated example, the user can stand and balance on a stationary SUP balance platform 207 while performing the paddle simulations. In an embodiment, the SUP balance platform 207 can be mounted on a movable platform which can rotate out of a horizontal orientation when the user is not balanced while paddling. This additional balancing can add more exercise requirements to the activity.

Figure 22:
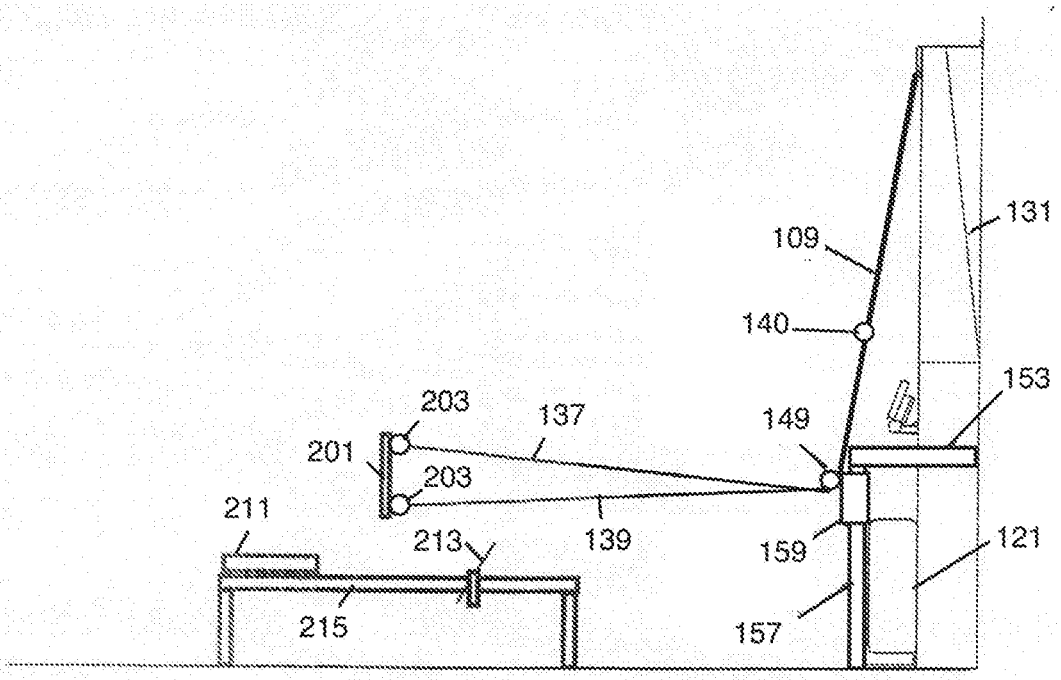
FIG. 22 illustrates a side view of a paddle shaft used with the exercise machine.

Kayak exercise simulation can be performed in a seated position. FIG. 22 illustrates a simulated kayak seat 211 with foot rests 213 which are mounted on a raised horizontal track 215 so that the position of the seat 211 and foot rests 213 can be adjusted to fit the user. In this embodiment, the user can sit in the simulated kayak seat 211 with the feet in the foot rests 213. The user can grasp the simulated paddle shaft 201 and perform paddle exercises in a manner that simulates an alternating left paddle and right paddle stroking as described above. Alternatively, in an embodiment, the seat 211 may slide on the horizontal track 215 and the user can pull back with both hands simultaneously and then move both hands forward simultaneously in the motion of a rowing shell. As the user's strength increases, the resistance of the flywheel 121 and power output can be increased.

Figure 23:
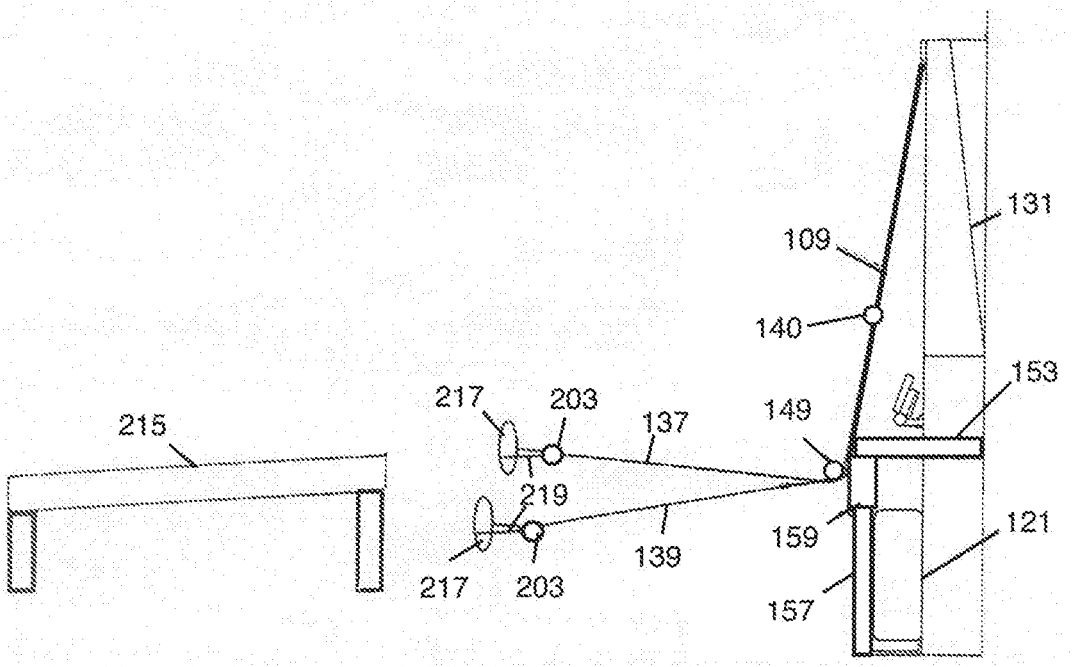
FIG. 23 illustrates a side view of hand paddles or exercise handles used with the exercise machine.

In another embodiment, the exercise system can be used for swimming simulations. FIG. 23 illustrates an angled bench 215 which can have a raised front side facing the exercise machine and a lower leg portion. A user can lay prone on the bench 215 to perform swimming exercises. Hand paddles 217 are coupled to the ends of the first adapter cord 137 and the second adapter cord 139 by paddle couplings 203. The hand paddles 217 can include a planar surface which is placed against the user's palms. Bridles 219 can be coupled to opposite sides of the planar surface of the hand paddles 217 and the first adapter cord 137 and the second adapter cord 139. The user can lay face down on the bench 215 facing the exercise machine frame 131. The hand paddles 217 can be placed on the palms of the hands and the user can simulate a swimming stroke such as freestyle, breast stroke, and/or butterfly. The user can also lay with his or her back against the bench 215 to perform backstroke.

In some embodiments, the level of work performed by a user can be measured with devices such as power meters or Ergometers. These meters can measure the force applied to the flywheel, the rotational velocity of the flywheel, and the duration of time that the force is applied. These measurements can be obtained by using strain gauges to determine the forces applied to the axle and flywheel. A processor can receive and process the strain gauge data to obtain the power data for the user activities with the exercise machine. The processor can output the user power data to a visual display mounted on the exercise equipment and the power data can be output to a computer memory and possibly a cloud storage system. The stored power data can be accessed by other computing devices.

Figure 24:
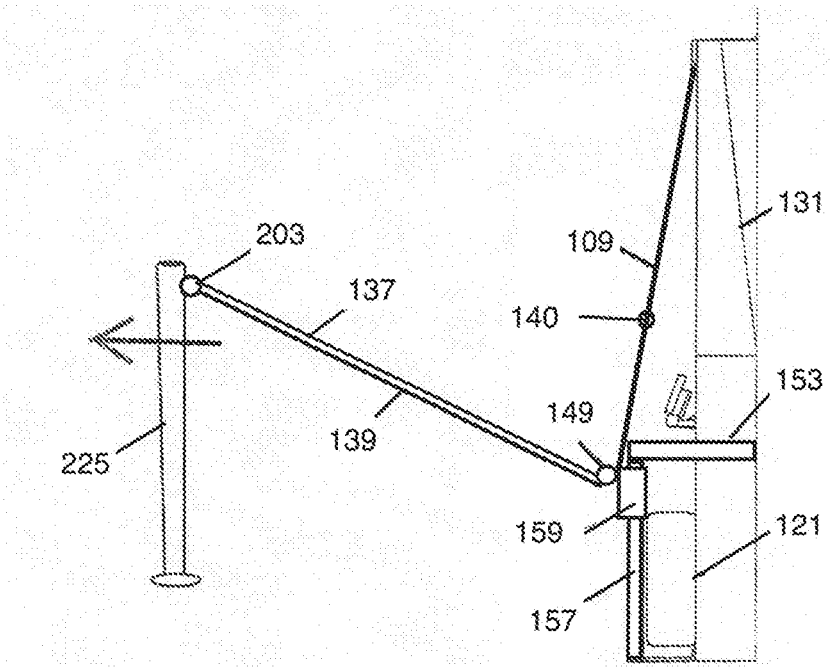
FIG. 24 illustrates a side view of a bat used with the exercise machine.

In addition to rowing, paddling, and swimming, the inventive exercise machine can be used for other sports simulations, as well as functional exercises for fitness conditioning and physical therapy or rehabilitation. With reference to FIG. 24, a baseball bat 225 can be coupled to the first cord 107 and/or the second cord 109 at a coupling 203. A user can grasp the handle portion of the bat 225 and the user can swing the bat 225 in a direction away from the exercise machine. The tension on the first adapter cord 137 and/or second adapter cord 139 can resist the bat 225 movement away from the exercise machine frame 131 and then retract the first adapter cord 137 and/or second adapter cord 139 when the bat 225 movement is towards the exercise machine frame 131. By using this bat 225 with the exercise machine, the user can develop muscles for improved batting performance.

Figure 25:
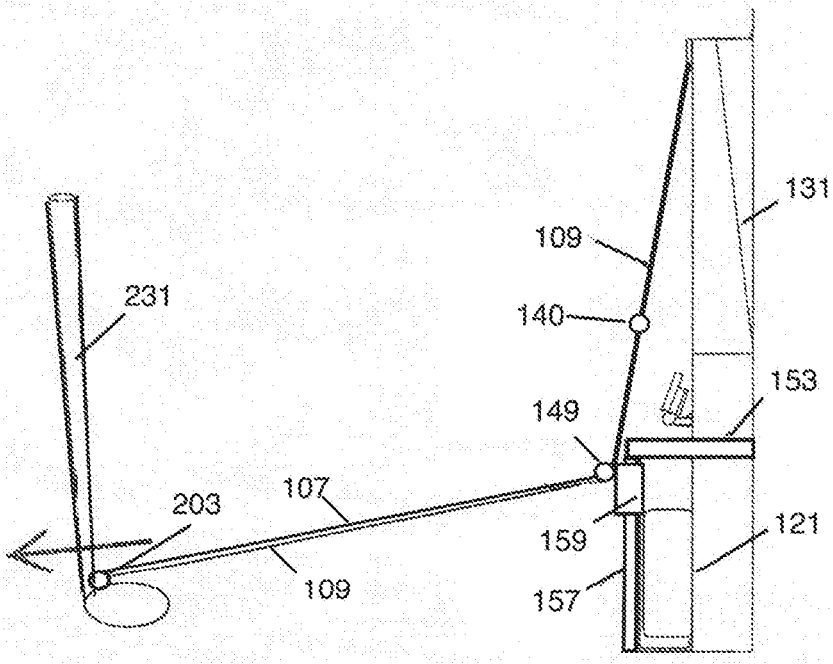
FIG. 25 illustrates a side view of a golf club used with the exercise machine.

In an embodiment with reference to FIG. 25, a golf club 231 can be attached to the first adapter cord 137 and/or the second adapter cord 139 at a coupling 203. A user can grasp the upper handle portion of the golf club 231 and swing the club 231 in a direction away from the exercise machine frame 131. The tension on the first adapter cord 137 and/or the second adapter cord 139 can resist the movement of the club 231 away from the exercise machine and rotate the flywheel 121. By using the golf club 231 with the exercise machine, the user can develop muscles for improved club swing performance.

Figure 26:
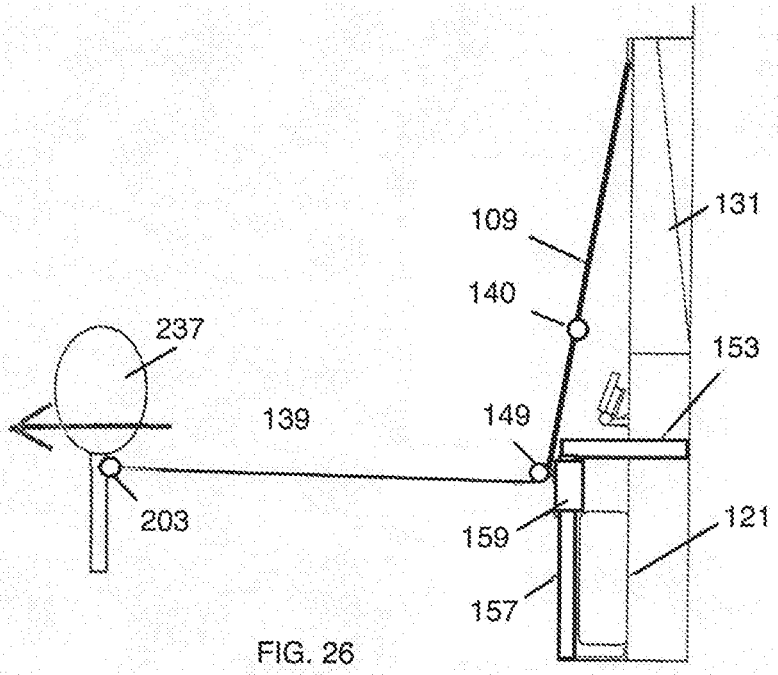
FIG. 26 illustrates a side view of racket used with the exercise machine.

In an embodiment with reference to FIG. 26, a racket such as a tennis racket 237 can be attached to the first adapter cord 137 and/or the second adapter cord 139 at a coupling 203. A user can grasp the grip handle of the racket 237 and swing the racket 237 in a direction away from the exercise machine frame 131. The tension on the first and second cords can resist the movement of the racket away from the exercise machine and rotate the flywheel 121. By using this racket 237 with the exercise machine, the user can develop muscles for improved racket swing performance.

Figure 27:
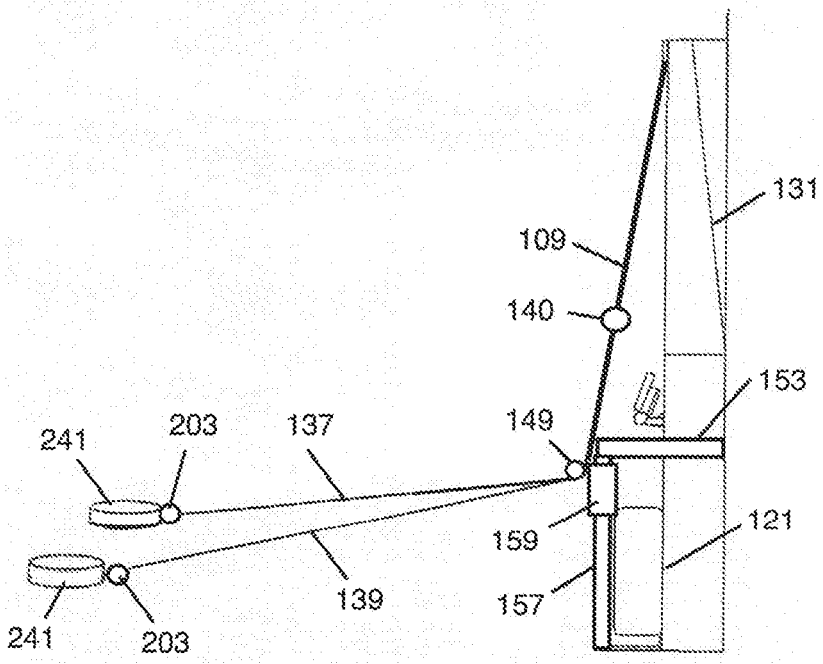
FIG. 27 illustrates a side view of leg straps used with the exercise machine.

In an embodiment as shown in FIG. 27, the illustrated embodiment of the exercise machine can be used to resist leg movements. The first adapter cord 137 and the second adapter cord 139 can each be attached to a foot strap 241. The foot straps 241 can be placed on the user's ankles and the user can move the legs or arms in a path that travels towards and away from the exercise machine frame 131. The tension on the first adapter cord 137 and second adapter cord 139 can resist the movement of the foot straps 241 attached to the legs away from the exercise machine and the retraction springs can rewind the original cords 107, 109 onto the spools when the legs move towards the exercise machine. By using the foot straps 241 with the exercise machine frame 131, the user can isolate and develop leg (or arm) muscles for improved athletic performance.

Figure 28:
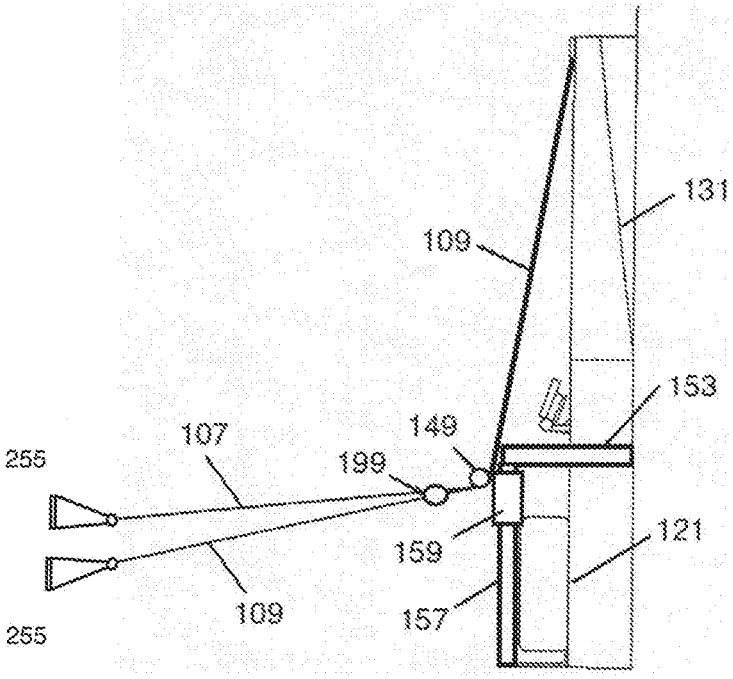
FIG. 28 illustrates a side view of exercise handles used with the exercise machine.

In an embodiment as shown in FIG. 28, the illustrated embodiment of the exercise machine can be used to resist arm and upper body movements. The first adapter cord 137 and the second adapter cord 139 can each be attached to exercise handles 255. The exercise handles 255 can be gripped by the user's hands and the user can move the arms in a path that travels towards and away from the exercise machine frame 131. The exercise handles 255 can include a bridle which is coupled to opposite sides of the handle. The tension on the first adapter cord 107 and second adapter cord 109 can resist the movement of the exercise handles 255 away from the exercise machine frame 131 and the retraction springs can rewind the original cords 107, 109 onto the spools when the arms move towards the exercise machine. By using the exercise handles 255 with the exercise machine frame 131, the user can isolate and develop arm, upper body and core muscles for improved athletic performance. In other embodiments, other sports equipment can be coupled to the adapter cords 137, 139 such as boxing gloves for boxing practice, a vest or strap worn by the user for sit up resistance, etc.

The exercise equipment shown in FIGS. 20 - 28 can be used with any of the exercise machines illustrated in FIGS. 1 - 19. As discussed, the exercise equipment illustrated in FIGS. 16 - 24 are coupled to the adapter cords 137, 139 with couplings 203. However, in different embodiments, the couplings 203 can have various mechanisms for connecting the exercise equipment to the adapter cords 137, 139. For example, in an embodiment the couplings 203 can have a ring or a hole and a shackle where a gate on the shackle is opened to attach the shackle to the loop or hole. The ring can be coupled to the exercise equipment or the ends of the adapter cords 137, 139. Alternatively, a loop can be formed at the ends of the adapter cords 137, 139. In another embodiment, a ring can be attached to the exercise equipment or a hole can be formed in the exercise equipment and the ends of the adapter cords 137, 139 can be secured to the rings with knots. In other embodiments, the couplings 203 can include other connection mechanisms such as an externally threaded structure that is screwed onto an internally threaded structure.

All references cited herein are intended to be incorporated by reference. Although the present invention has been described above in terms of specific embodiments, it is anticipated that alterations and modifications to this invention will no doubt become apparent to those skilled in the art and may be practiced within the scope and equivalents of the appended claims. The present embodiments are to be considered as illustrative and not restrictive, and the invention is not to be limited to the details given herein. It is therefore intended that the disclosure and following claims be interpreted as covering all such alterations and modifications as fall within the true spirit and scope of the invention.

What is claimed is:

1. An exercise machine comprising:

a flywheel which rotates about an axle;

an upright elongated frame having a base and an upper left section and an upper right section wherein bottom ends of the upper left section and the upper right section are coupled to a top end of the base and the flywheel is coupled to the base of the frame;

a first upper pulley coupled to the upper left section and a second upper pulley coupled to the upper right section of the upright elongated frame wherein the first upper pulley and the second upper pulley are above the flywheel;

a first spool and a second spool attached to the axle;

a first original cord wrapped around the first spool and extending around the first upper pulley wherein the first original cord bends through a first angle between 130 and 180 degrees through the first upper pulley down towards a first lower pulley coupled to a bracket that is rigidly coupled to the upright elongated frame and adjacent to the flywheel;

a second original cord wrapped around the second spool and extending around the second upper pulley wherein the second original cord bends through a second angle between 130 and 180 degrees through the second upper pulley down towards a second lower pulley coupled to the bracket;

a first releasable coupling attached to a first end of the first original cord;

a second releasable coupling attached to a second end of the second original cord;

a first adapter cord coupled to the first releasable coupling and extending through the first lower pulley; and a second adapter cord coupled to the second releasable coupling and extending through the second lower pulley.

2. The exercise machine of claim 1 further comprising:

a vertical rail coupled to the bracket attached to the base of the frame; and a horizontal crossbar attached to an adjustable coupling attached to the vertical rail and the first lower pulley and the second lower pulley are coupled to the horizontal cross bar;

wherein vertical positions of the first lower pulley and the second lower pulley are adjusted via the position of the adjustable coupling to the vertical rail.

3. The exercise machine of claim 1 further comprising:

a first handle coupled to the first adapter cord; and a second handle coupled to the second adapter cord.

4. The exercise machine of claim 3 further comprising:

an elongated bench adjacent to the upright elongated frame wherein the upright elongated frame is aligned with a center line of the elongated bench and a front side of the elongated bench which is closest to the upright elongated frame is higher than a rear side of the elongated bench which is farther from the frame.

5. The exercise machine of claim 1 further comprising:

a simulated paddle wherein the first coupling is attached to a first side of the simulated paddle and the second coupling is attached to a second side of the simulated paddle.

6. The exercise machine of claim 5 further comprising:

a grip handle coupled to an end of the simulated paddle.

7. The exercise machine of claim 5 further comprising:

a seat adjacent to the upright elongated frame wherein the upright elongated frame is aligned with a center line of the seat.

8. The exercise machine of claim 5 further comprising:

a raised horizontal rail;

an adjustable seat mounted on the raised horizontal rail; and a foot rest mounted on the raised horizontal rail;

wherein the upright elongated frame is aligned with the raised horizontal rail and center lines of the seat and the foot rest.

9. An exercise machine comprising:

a flywheel which rotates about an axle;

an upright elongated frame having a base and an upper left section and an upper right section wherein bottom ends of the upper left section and the upper right section are coupled to a top end of the base and the flywheel is coupled to the base of the frame;

a first upper pulley coupled to the upper left section and a second upper pulley coupled to the upper right section of the upright elongated frame wherein the first upper pulley and the second upper pulley are above the flywheel;

a first spool and a second spool attached to the axle;

a bracket rigidly coupled to the exercise machine frame, the bracket having a plurality of mountings on a front-facing surface of the bracket wherein the bracket is adjacent to the flywheel;

a first lower pulley attached to a first mounting of the plurality of mountings on the bracket;

a second lower pulley attached to a second mounting of the plurality of mountings on the bracket;

a first original cord having a first cord end wrapped around the first spool and the first original cord extending around the first upper pulley wherein the first original cord bends through a first angle between 130 and 180 degrees through the first upper pulley down towards the first lower pulley;

a second original cord having a second cord end wrapped around the second spool and the second original cord extending around the second upper pulley wherein the second original cord bends through a second angle between 130 and 180 degrees through the second upper pulley down towards the second lower pulley;

a first coupling attached to a first end of the first original cord;

a second coupling attached to a second end of the second original cord;

a first adapter cord attached to the first coupling and extending through the first lower pulley; and a second adapter cord attached to the second coupling and extending through the second lower pulley.

10. The exercise machine of claim 9 further comprising:

a first handle coupled to the first adapter cord; and a second handle coupled to the second adapter cord.

11. The exercise machine of claim 9 further comprising:

an elongated bench adjacent to the upright elongated frame wherein the upright elongated frame is aligned with a center line of the elongated bench and a front side of the elongated bench which is closest to the upright elongated frame is higher than a rear side of the elongated bench which is farther from the frame.

12. The exercise machine of claim 9 further comprising:

a paddle shaft wherein the first coupling is attached to a first side of the paddle shaft and the second coupling is attached to a second side of the paddle shaft.

13. The exercise machine of claim 12 further comprising:

a grip handle coupled to an end of the paddle shaft.

14. The exercise machine of claim 9 further comprising:

a paddle shaft wherein the first coupling is attached to a first side of the paddle shaft and the second coupling is attached to a second side of the paddle shaft; and a seat adjacent to the upright elongated frame wherein the upright elongated frame is aligned with a center line of the seat.

15. An exercise machine comprising:

a flywheel which rotates about an axle;

an upright elongated frame having a base and an upper left section and an upper right section wherein bottom ends of the upper left section and the upper right section are coupled to a top end of the base and the flywheel is coupled to the base of the frame;

a first upper pulley coupled to the upper left section and a second upper pulley coupled to the upper right section of the upright elongated frame wherein the first upper pulley and the second upper pulley are above the flywheel;

a first spool and a second spool attached to the axle;

a bracket rigidly coupled to the upright elongated frame having a right portion adjacent to a right side of the flywheel and a left portion adjacent to a left side of the flywheel, the bracket having a plurality of mounting hooks on a front facing surface of the bracket;

a first lower pulley attached to a first mounting hook of the plurality of mounting hooks on the bracket;

a second lower pulley attached to a second mounting hook of the plurality of mounting hooks on the bracket;

a first original cord having a first cord end wrapped around the first spool and the first original cord extending around the first upper pulley wherein the first original cord bends through a first angle between 130 and 180 degrees through the first upper pulley down towards the first lower pulley;

a second original cord having a second cord end wrapped around the second spool and the second original cord extending around the second upper pulley wherein the second original cord bends through a second angle between 130 and 180 degrees through the second upper pulley down towards the second lower pulley;

a first adapter cord coupled to the first original cord and the first adapter cord extending around the first lower pulley; and a second adapter cord coupled to the second original cord and the second adapter cord extending around the second lower pulley.

16. The exercise machine of claim 15 further comprising:

a first coupling attached to the first original cord and the first adapter cord; and a second coupling attached to the second original cord and the second adapter cord.

17. The exercise machine of claim 15 further comprising:

a first handle coupled to the first adapter cord; and a second handle coupled to the second adapter cord.

18. The exercise machine of claim 15 further comprising:

a paddle shaft wherein the first cord is attached to a first side of the paddle shaft and the second adapter cord is attached to a second side of the paddle shaft.

19. The exercise machine of claim 18 further comprising:

a grip handle coupled to an end of the paddle shaft.

20. The exercise machine of claim 15 further comprising at least one of:

a first handle coupled to a first adapter coupling that is coupled to the first adapter cord and a second handle coupled to a second adapter coupling that is coupled to the second adapter cord;

a paddle shaft wherein the first adapter cord is attached to a first portion of the paddle shaft and the second adapter cord is attached to a second portion of the paddle shaft that is on an opposite side of the paddle shaft;

a grip handle coupled to an end of the paddle shaft wherein the first adapter cord is attached to a grip handle portion of the paddle shaft and the second adapter cord is attached to a second portion of the paddle shaft that is on an opposite side of the paddle shaft; and a first strap coupled to a first adapter coupling that is coupled to the first adapter cord and a second strap coupled to a second adapter coupling that is coupled to the second adapter cord.

* * * * *